US008463169B2

(12) United States Patent
Yamaji

(10) Patent No.: US 8,463,169 B2
(45) Date of Patent: Jun. 11, 2013

(54) FIXING DEVICE, IMAGE FORMING APPARATUS AND METHOD FOR EVALUATING FIXING DEVICE

(75) Inventor: Hiroyuki Yamaji, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 236 days.

(21) Appl. No.: 12/959,603

(22) Filed: Dec. 3, 2010

(65) Prior Publication Data

US 2011/0142506 A1 Jun. 16, 2011

(30) Foreign Application Priority Data

Dec. 10, 2009 (JP) ..... 2009-280743

(51) Int. Cl.
*G03G 15/20* (2006.01)

(52) U.S. Cl.
USPC ..... 399/333; 399/328; 399/330; 399/331

(58) Field of Classification Search
USPC ..... 399/328, 333
See application file for complete search history.

(56) References Cited

U.S. PATENT DOCUMENTS

| | | | | |
|---|---|---|---|---|
| 5,517,292 | A * | 5/1996 | Yajima et al. | 399/323 |
| 5,581,340 | A * | 12/1996 | Hayashi et al. | 399/328 |
| 6,052,549 | A * | 4/2000 | Shimura et al. | 399/176 |
| 6,377,777 | B1 * | 4/2002 | Kishino et al. | 399/329 |
| 6,603,947 | B2 | 8/2003 | Katayanagi et al. | |
| 6,782,232 | B2 | 8/2004 | Hayami et al. | |
| 6,816,699 | B1 | 11/2004 | Katayanagi et al. | |
| 2002/0044803 | A1 * | 4/2002 | Kobaru et al. | 399/323 |
| 2002/0098018 | A1 | 7/2002 | Kamiya | |
| 2002/0102116 | A1 | 8/2002 | Katayanagi et al. | |
| 2003/0180075 | A1 | 9/2003 | Hayami et al. | |
| 2008/0038026 | A1 * | 2/2008 | Al et al. | 399/328 |

FOREIGN PATENT DOCUMENTS

| | | | |
|---|---|---|---|
| JP | 04-178676 | A | 6/1992 |
| JP | 09-325633 | A | 12/1997 |
| JP | 10-293494 | A | 11/1998 |
| JP | 2000-075714 | A | 3/2000 |
| JP | 2000-221823 | A | 8/2000 |
| JP | 2000-259027 | A | 9/2000 |
| JP | 2000-284524 | A | 10/2000 |
| JP | 2002-031978 | A | 1/2002 |
| JP | 2002-156858 | A | 5/2002 |
| JP | 2003-280436 | A | 10/2003 |
| JP | 2004-233644 | A | 8/2004 |

* cited by examiner

*Primary Examiner* — David Gray
*Assistant Examiner* — Tyler Hardman
(74) *Attorney, Agent, or Firm* — Renner, Otto, Boisselle & Sklar, LLP

(57) ABSTRACT

A fixing device includes a fixing roller and a pressure roller. The fixing roller and the pressure roller each have an elastic layer formed between a core bar and a release layer, which release layer serves as a surface of the fixing roller and the pressure roller. The pressure roller has a lower Asker-C hardness than that of the fixing roller, and has a greater micro rubber hardness than that of the fixing roller. This prevents the surface of the pressure roller from deteriorating in a short period of time.

5 Claims, 5 Drawing Sheets

FIG. 4

| | FIXING ROLLER A | PRESSURE ROLLER B | PRESSURE ROLLER C | PRESSURE ROLLER D | PRESSURE ROLLER E | PRESSURE ROLLER F |
|---|---|---|---|---|---|---|
| RELEASE LAYER THICKNESS | 30 μm | 50 μm | 50 μm | 70 μm | 120 μm | 120 μm |
| ELASTIC LAYER HARDNESS | 10 DEGREE | 30 DEGREE | 40 DEGREE | 40 DEGREE | 30 DEGREE | 40 DEGREE |
| ELASTIC LAYER THICKNESS | 200 μm | 5mm | 5mm | 5mm | 5mm | 5mm |
| ASKER-C HARDNESS | 96 DEGREE | 68 DEGREE | 71 DEGREE | 72 DEGREE | 71 DEGREE | 73 DEGREE |
| MICRO RUBBER HARDNESS | 83 DEGREE | 75 DEGREE | 77 DEGREE | 81 DEGREE | 90 DEGREE | 91 DEGREE |

FIG. 5

| | COMPARATIVE EXAMPLE 1 | COMPARATIVE EXAMPLE 2 | COMPARATIVE EXAMPLE 3 | EXAMPLE 1 | EXAMPLE 2 |
|---|---|---|---|---|---|
| COMPONENT | FIXING ROLLER A<br>PRESSURE ROLLER B | FIXING ROLLER A<br>PRESSURE ROLLER C | FIXING ROLLER A<br>PRESSURE ROLLER D | FIXING ROLLER A<br>PRESSURE ROLLER E | FIXING ROLLER A<br>PRESSURE ROLLER F |
| ASKER-C HARDNESS | FIXING ROLLER<br>→96 DEGREE<br>PRESSURE ROLLER<br>→68 DEGREE | FIXING ROLLER<br>→96 DEGREE<br>PRESSURE ROLLER<br>→71 DEGREE | FIXING ROLLER<br>→96 DEGREE<br>PRESSURE ROLLER<br>→72 DEGREE | FIXING ROLLER<br>→96 DEGREE<br>PRESSURE ROLLER<br>→71 DEGREE | FIXING ROLLER<br>→96 DEGREE<br>PRESSURE ROLLER<br>→73 DEGREE |
| MICRO RUBBER HARDNESS | FIXING ROLLER<br>→83 DEGREE<br>PRESSURE ROLLER<br>→75 DEGREE | FIXING ROLLER<br>→83 DEGREE<br>PRESSURE ROLLER<br>→77 DEGREE | FIXING ROLLER<br>→83 DEGREE<br>PRESSURE ROLLER<br>→81 DEGREE | FIXING ROLLER<br>→83 DEGREE<br>PRESSURE ROLLER<br>→90 DEGREE | FIXING ROLLER<br>→83 DEGREE<br>PRESSURE ROLLER<br>→91 DEGREE |
| AFTER PASSAGE OF 300,000 SHEETS | FIXING ROLLER<br>→ ○<br>PRESSURE ROLLER<br>→ ×× | FIXING ROLLER<br>→ ○<br>PRESSURE ROLLER<br>→ × | FIXING ROLLER<br>→ ○<br>PRESSURE ROLLER<br>→ □ | FIXING ROLLER<br>→ ○<br>PRESSURE ROLLER<br>→ ○ | FIXING ROLLER<br>→ ○<br>PRESSURE ROLLER<br>→ ○ |
| AFTER PASSAGE OF 500,000 SHEETS | FIXING ROLLER<br>→ □<br>PRESSURE ROLLER<br>→ — | FIXING ROLLER<br>→ □<br>PRESSURE ROLLER<br>→ — | FIXING ROLLER<br>→ □<br>PRESSURE ROLLER<br>→ × | FIXING ROLLER<br>→ □<br>PRESSURE ROLLER<br>→ □ | FIXING ROLLER<br>→ □<br>PRESSURE ROLLER<br>→ □ |

FIXING DEVICE, IMAGE FORMING APPARATUS AND METHOD FOR EVALUATING FIXING DEVICE

This Nonprovisional application claims priority under 35 U.S.C. §119(a) on Patent Application No. 2009-280743 filed in Japan on Dec. 10, 2009, the entire contents of which are hereby incorporated by reference.

TECHNICAL FIELD

The present invention relates to a fixing device that is provided in an electrophotographic image forming apparatus.

BACKGROUND ART

An electrophotographic image forming apparatus has good reproducibility and operability, and can form a high-definition image at low cost. Therefore, such an image forming apparatus is used in many ways, for example, as a copying machine, a printer, a facsimile, and a multifunction printer that has two or more functions of the copying machine, the printer and the facsimile. The electrophotographic image forming apparatus includes a photoreceptor, a charging device, an exposure device, a developing device, a transfer device and a fixing device. The photoreceptor is a member on which surface an electrostatic latent image is formed in accordance with image information. The charging device is a member that charges the surface of the photoreceptor. The exposure device is a member which emits signal light to the charged photoreceptor surface, to form the electrostatic latent image on the photoreceptor surface. The developing device is a member which supplies toner to the electrostatic latent image formed on the photoreceptor surface, to form a toner image on the photoreceptor surface. The transfer device is a member that transfers the toner image formed on the photoreceptor surface to a sheet (recording medium). The fixing device is a member that fixes, to the sheet, the toner image transferred to the sheet.

A roller device including a fixing roller and a pressure roller is generally used as the fixing device. The fixing roller (heating roller) includes a heater (heating section). The pressure roller is provided by being in contact with and applying pressure to the fixing roller; due to elastic deformation of an elastic layer in the pressure roller, a nip section is formed between the fixing roller and the pressure roller. The fixing device that employs the fixing roller (heating roller) sandwiches, at the nip section between the fixing roller and the pressure roller, a sheet on which an unfixed toner image is formed. This sheet is carried by rotating the fixing roller and the pressure roller; meanwhile, the toner image formed on the sheet is melted by the heat of the surface of the fixing roller and is fixed to the sheet. Further, the pressure roller causes the sheet to be pressed against the fixing roller, which pressure reinforces the fixing of the toner image to the sheet.

Recently, demands have been increasing for attaining energy efficiency with the fixing device in terms of environmental protection, and therefore a fixing device with a reduced warm-up period has been actively developed. The following methods are some examples of how to reduce the warm-up period: attaining high-efficiency in generation of electric heat (heat exchange) with a heater inside the fixing roller; reducing heat capacity of the fixing roller; and the like. A fixing roller used for monochrome printing is generally made up of a metal core bar whose periphery is covered with fluorinated resin or a fluorinated tube to obtain toner releasability, and has a heat source (heater) such as a halogen lamp provided inside the core bar. Further, as disclosed in, for example, Patent Literatures 2 and 3, the pressure roller has a relatively thick elastic layer made of a heat-resistant rubber or sponge formed around the metal core bar, which elastic layer is covered with fluorinated resin or a fluorinated tube to attain the toner releasability. The pressure roller having such a configuration is pressed against the fixing roller, thereby causing elastic deformation of the pressure roller. As a result, a fixing nip is formed, where toner is fixed onto the sheet.

Further, a fixing roller having the following configuration is used: an elastic layer made of, for example, silicon rubber, is formed around a core bar, and a release layer is formed as a surface layer on a peripheral surface of the elastic layer. A fixing device that employs the fixing roller having such a configuration is disclosed in, for example, Patent Literature 1 or 4 as a fixing device used for color printing. The fixing device used for color printing employs a fixing roller that has a relatively thick elastic layer whose thickness is of a few millimeters. This causes delay in an initiation period or the like, contrary to attaining energy efficiency. However, an effect caused by the delay in the initiation period or the like is reduced by reducing thickness of the elastic layer. Further, the elastic layer made of silicon rubber serves as a heat insulating layer. This can prevent excessive heat transfer from the fixing roller via a fixing nip section to the pressure roller, and therefore improves temperature following capability. This also improves adhesiveness between a surface of the fixing roller and a sheet surface, thereby improving fixing capability.

CITATION LIST

Patent Literature

Patent Literature 1
Japanese Patent Application Publication Tokukai No. 2000-75714 A (Publication Date: Mar. 14, 2000)
Patent Literature 2
Japanese Patent Application Publication Tokukai No. 2000-221823 A (Publication Date: Aug. 11, 2000)
Patent Literature 3
Japanese Patent Application Publication Tokukai No. 2002-31978 A (Publication Date: Jan. 31, 2002)
Patent Literature 4
Japanese Patent Application Publication Tokukai No. 2002-156858 A (Publication Date: May 31, 2002)

SUMMARY OF INVENTION

Technical Problem

With a fixing device used for monochrome printing, specifications of the pressure roller and the fixing roller are generally determined so that the pressure roller elastically deforms in a greater degree than the fixing roller. Therefore, a load given on the pressure roller is greater than that given on the fixing roller. Consequently, endurance of the pressure roller serves as a factor for determining endurance of an entire fixing device. That is, the following problem occurs in the above-described fixing device: although the fixing roller has not deteriorated yet, wrinkles, cracks and the like occur in a surface part of the pressure roller, thereby reducing a usable period of the entire fixing device.

An object of the present invention is to prevent a surface part of a pressure roller in a pair-roller fixing device from deteriorating in a short period of time.

Solution to Problem

In order to attain the object, a fixing device of the present invention including: a fixing roller; a pressure roller; and a heat source that heats the fixing roller, each of the fixing roller and the pressure roller including a core bar, an elastic layer and a release layer, the elastic layer being sandwiched between the core bar and the release layer, the release layer serving as a surface of a respective fixing roller and pressure roller, the pressure roller being pressed against and made in contact with the fixing roller to form an abutted part where the pressure roller is in contact with the fixing roller, the fixing roller and the pressure roller sandwiching and carrying a sheet at the abutted part to melt by heat, and fix to the sheet, unfixed toner provided on a surface of the sheet which surface is to be in contact with the fixing roller, the pressure roller having a lower Asker-C hardness than that of the fixing roller and having a greater micro rubber hardness than that of the fixing roller.

According to the arrangement of the present invention, the pressure roller having a lower Asker-C hardness than that of the fixing roller is pressed against and is in contact with the fixing roller. Hence, the pressure roller is distorted in a greater degree than the fixing roller due to elastic deformation, or just the pressure roller is distorted due to the elastic deformation while no distortion occurs to the fixing roller due to the elastic deformation. However, since the pressure roller has a greater micro rubber hardness than that of the fixing roller, the pressure roller has a greater endurance than that of the fixing roller in terms of just the roller surfaces. This yields an effect that it is possible to prevent the occurrence of a case where just a surface of the pressure roller is deteriorated in a short period of time.

Advantageous Effects of Invention

As described above, in the present invention, a pressure roller has a lower Asker-C hardness than that of the fixing roller and a greater micro rubber hardness than that of the fixing roller. This yields an effect that it is possible to prevent the occurrence of a case where just a surface of the pressure roller is deteriorated in a short period of time.

BRIEF DESCRIPTION OF DRAWINGS

FIG. 4 is a chart that shows specifications of a fixing roller and a pressure roller that are used in an endurance experiment.

FIG. 5 is a chart that shows a result of an endurance experiment.

DESCRIPTION OF EMBODIMENTS

Figure 1:
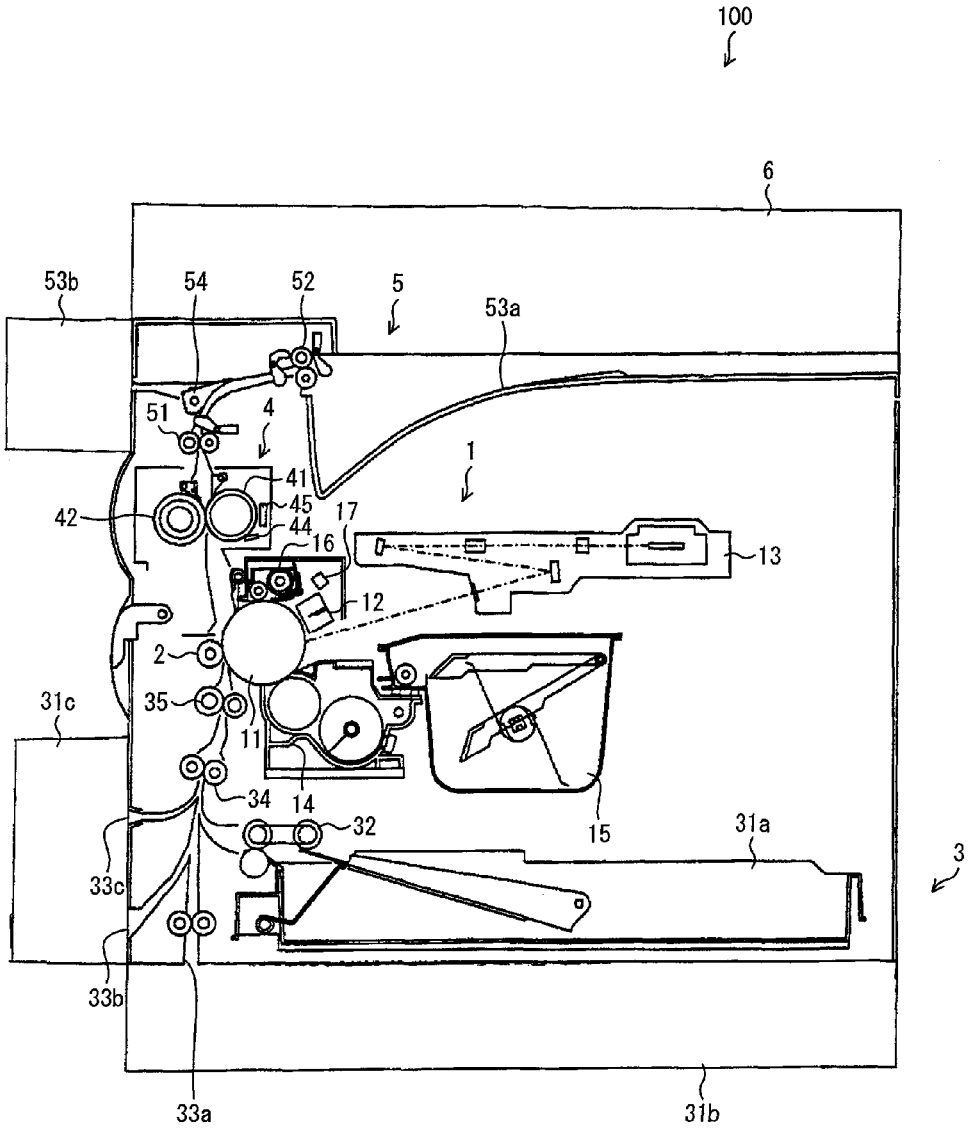
FIG. 1 is a view schematically showing an inner configuration of an image forming apparatus that includes a fixing device of the present embodiment.

The following describes an embodiment of the present invention with reference to drawings. FIG. 1 is a view schematically showing an inner configuration of an image forming apparatus that includes a fixing device of the present embodiment. An image forming apparatus 100 includes: a toner image forming section 1; a transfer device 2; a sheet feeding section 3; a fixing device 4; a discharge section 5; and an image reading section 6.

The image reading section 6 includes a platen, a light source and a CCD (charge-coupled device) image sensor. A document to be copied is placed on an upper surface of the platen. The platen is a plate-like member made of transparent material such as transparent glass. The light source illuminates the document that is placed on the platen. The CCD image sensor photoelectrically converts light that is reflected from the document illuminated by the light source into image information (an analog signal). The image information of the analog signal is converted into a digital signal by a control unit 7 (see FIG. 2) described later and then stored in the control unit 7.

The toner image forming section 1 includes: a photoreceptor drum 11; a charging device 12; a light scanning unit 13; a developing device 14; a developer supply container 15; a drum cleaner 16; and a photoreceptor charge removal device 17.

The photoreceptor drum 11 is a roller member that is supported rotatably about an axis by a drive motor (not shown). The photoreceptor drum 11 includes a photoreceptor layer, and is an image bearing member that bears, on a surface of the photoreceptor layer, an electrostatic latent image, consequently a toner image.

An example of a usable photoreceptor drum 11 is a photoreceptor drum that is constructed of a conductive base made of aluminum or the like and a photoreceptor layer formed on a surface of the conductive base. The conductive base may be shaped to be a hollow cylindrical, unhollowed cylindrical, sheet-form, or like shape. Particularly, a hollow cylindrical conductive base is preferably used among these shapes. Further, examples of the photoreceptor layer encompass an organic photoreceptor layer and an inorganic photoreceptor layer.

For example, a laminated body in which a charge generating layer which is a resin layer including a charge generating substance, and a charge carrying layer which is a resin layer including a charge carrying substance, are stacked on top of each other, or a resin layer that includes the charge generating substance and the charge carrying substance in a single resin layer, can be used as the organic photoreceptor layer. An example of the inorganic photoreceptor layer is a resin layer that contains one or more of zinc oxide, selenium, amorphous silicon and like material.

An undercoat layer may be provided between the conductive base and the photoreceptor layer. Further, a surface layer (protective layer) may be provided on a surface of the photoreceptor layer in order to protect the photoreceptor layer.

The charging device 12 is a member that charges a surface of the photoreceptor drum 11 so that the surface of the photoreceptor drum 11 has a specific polarity and electric potential. The charging device 12 is provided along a longitudinal direction of the photoreceptor drum 11, so as to face the photoreceptor drum 11. In a case where the charging device 12 charges the surface of the photoreceptor drum 11 by contact electrification, the charging device 12 is provided to be in contact with the surface of the photoreceptor drum 11. In a case where the charging device 12 charges the surface of the photoreceptor drum 11 by non-contact electrification, the charging device 12 is provided not to be in contact with the surface of the photoreceptor drum 11.

Examples of devices usable as the charging device 12 encompass: a brush-type charging device; a roller-type charging device; a corona discharge device; and an ion generator. The brush-type charging device and the roller-type charging device are charging devices employing the contact electrification. Examples of the brush-type charging device encompass: a brush-type charging device that uses a charged brush; and a brush-type charging device that uses a magnetic brush. The corona discharge device and the ion generator are charging devices employing the non-contact electrification.

Examples of the corona discharge device encompass: a corona discharge device that uses a wire-form discharge electrode; a corona discharge device that uses a saw-like discharge electrode; and a corona discharge device that uses a needle-shaped discharge electrode.

The light scanning unit 13 emits laser light in accordance with image information in the form of a digital signal to the surface of the charged photoreceptor drum 11 to form, on the surface of the photoreceptor drum 11, an electrostatic latent image corresponding to the image information. The light scanning unit 13 may be a semiconductor laser device or like device.

The developing device 14 includes a developing roller, a developing tank and a stirring roller. The developing roller is a roller member that is supported rotatably about an axis of the developing roller, in the developing tank. The developing roller is provided so that a part of the developing roller projects out from an opening on a side of the developing tank which side faces the photoreceptor drum 11, and so that the developing roller comes close to the surface of the photoreceptor drum 11.

The developing roller includes a fixed magnetic pole (not shown). The fixed magnetic pole causes a developer to be borne on a surface of the developing roller. The developing roller supplies the borne developer to an electrostatic latent image formed on the surface of the photoreceptor drum 11, at a neighboring section (developing nip section) between the developing roller and the photoreceptor drum 11, to form the toner image on the surface of the photoreceptor drum 11. The developing roller rotates in a direction opposite to a direction in which the photoreceptor drum 11 rotates. Therefore, the surface of the developing roller and the surface of the photoreceptor drum 11 move in the same direction, at the developing nip section.

The developing roller is connected to a power supply (not shown). The power supply applies a direct-current voltage (developing voltage) to the developing roller. This allows smooth supply of the developer borne on the surface of the developing roller to the electrostatic latent image.

The developing tank is a container having an opening on the side of the developing tank which side faces the photoreceptor drum 11, and which has an internal space for storing the developer. The developing tank has the stirring roller provided in its internal space. Any developer that is often used in this field can be used as the developer. The developer may be a single component developer made of only toner or may be a two component developer including toner and a carrier.

The stirring roller is a screw that is provided rotatable about an axis in the internal space of the developing tank. The developer stored in the developing tank is supplied to peripheries of the developing roller, by having the stirring roller rotate in the developing tank.

The developer supply container 15 is a container that stores the developer in an internal space of the developer supply container 15. The developer supply container 15 supplies the developer to the developing tank in accordance with how much the developer has been consumed in the developing device 14.

The drum cleaner 16 removes and collects the developer that remains on the surface of the photoreceptor drum 11 after the toner image formed on the surface of the photoreceptor drum 11 is transferred to a sheet.

The photoreceptor charge removal device 17 removes electricity from the surface of the photoreceptor drum 11 from which the developer has been collected by the drum cleaner 16. A lighting apparatus such as a lamp is used as the photoreceptor charge removal device 17.

The transfer device 2 is a roller member that is provided rotatable about an axis by a drive motor (not shown). The transfer device 2 is pressed against and is made in contact with the photoreceptor drum 11. A pressure area between the transfer device 2 and the photoreceptor drum 11 is called a transfer nip section. The transfer device 2 transfers the toner image formed on the photoreceptor drum 11 to the sheet that is supplied by the sheet feeding section 3, at the transfer nip section. The sheet that has passed through the transfer nip section is carried to the fixing device 4.

An example of the transfer device 2 is a roller member that includes a metal shaft body and a conductive layer that covers a surface of the metal shaft body. The metal shaft body is made of, for example, a metal such as a stainless steel. The conductive layer is made of, for example, a conductive elastic body. A conductive elastic body that is often used in this field can be used as the conductive elastic body. Examples of the conductive elastic body encompass ethylene-propylene-diene rubber (EPDM), EPDM foam, and urethane foam, each of which includes a conductive agent such as carbon black.

The transfer device 2 is connected to a high-voltage power supply (not shown). The high-voltage power supply applies, to the transfer device 2, a high voltage having a polarity opposite to a charged polarity of the toner image formed on the surface of the photoreceptor drum 11. This allows smooth transfer of the toner image formed on the surface of the photoreceptor drum 11 to a sheet surface.

The sheet feeding section 3 includes cassettes 31*a*, 31*b* and 31*c*, a pick-up roller 32, a carrying roller 34 and a resist roller 35. The cassettes 31*a*, 31*b* and 31*c* store sheets (recording media). Examples of the sheets encompass regular paper, coated paper, paper exclusive to color printing, OHP films, and postcards. Examples of sheet size encompass: A4, A3, B5, B4 and postcard size.

The pick-up roller 32 is a member that carries the sheets one by one to the carrying roller 34. Sheets stored in the cassette 31*a* are carried to the carrying roller 34 by the pick-up roller 32. Sheets stored in the cassette 31*b* are carried to the carrying roller 34 via a sheet receiving opening 33*a*. Sheets stored in the cassette 31*c* are carried to the carrying roller 34 via a sheet receiving opening 33*b* or a sheet receiving opening 33*c*.

The carrying roller 34 is a pair of members that are provided so as to abut each other. The carrying roller 34 carries sheets to the resist roller 35.

The resist roller 35 is a pair of members that are provided so as to abut each other. The resist roller 35 carries the sheets to the transfer nip section in synchronization with carriage of the toner image formed on the photoreceptor drum 11 to the transfer nip section.

The fixing device 4 is a device that fixes an unfixed toner image that is formed on a sheet, onto that sheet. The sheet on which the unfixed toner image is formed is carried from the transfer device 2 to the fixing device 4, and is applied with heat and pressure at the fixing device 4. This heat and pressure melts the toner that forms the unfixed toner image, to fix the unfixed toner image onto the sheet. The sheet on which the toner image has been fixed is carried to the discharge section 5.

Figure 2:
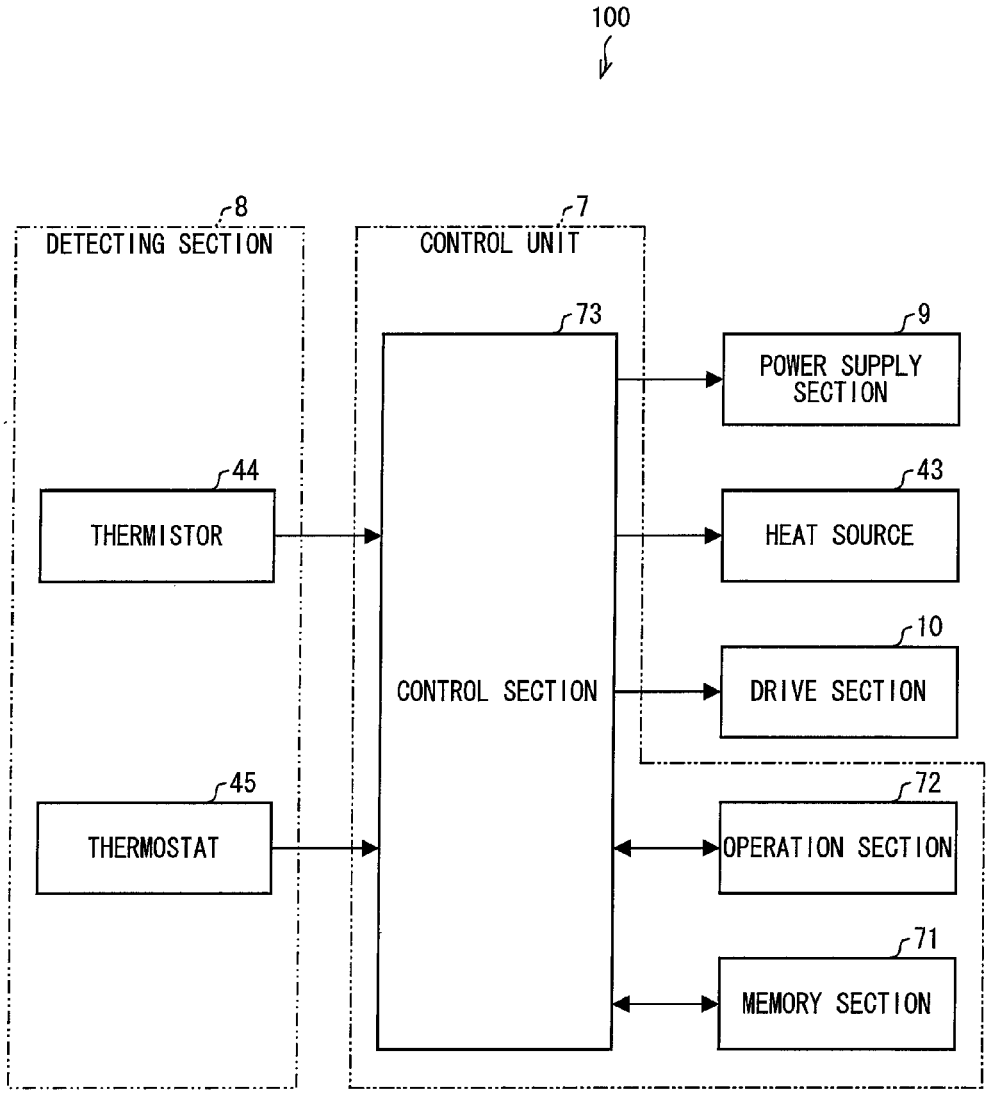
FIG. 2 is a block diagram that shows an electric configuration of an image forming apparatus of the present embodiment.

The fixing device 4 includes a fixing roller 41, a pressure roller 42, a thermistor 44, a thermostat 45 and a heat source 43 (see FIG. 2). The fixing roller 41 is a member that is driven to rotate by a drive motor (not shown). The pressure roller 42 is a member that applies pressure to a peripheral surface of the fixing roller 41 by a specific pressure. The pressure roller 42 is caused to rotate by the rotation of the fixing roller 41. An abutted part between the fixing roller 41 and the pressure roller 42 is called a fixing nip section. The fixing roller 41 and the pressure roller 42 heat and apply pressure to the sheet at the fixing nip section. The heat source 43 is an electric heating device that is provided inside the fixing roller 41. The heat source 43 is connected to a power supply (not shown) and heats the fixing roller 41 from its inside. The fixing roller 41, the pressure roller 42 and the heat source 43 are described in detail later.

The thermistor 44 is a sensor that detects a temperature of the fixing roller 41. The heat source 43 heats the fixing roller 41 in a case where the thermistor 44 detects that the fixing roller 41 is at a temperature lower than a set value. Further, the heat source 43 stops heating the fixing roller 41 in a case where the thermistor 44 detects that the fixing roller 41 is at a temperature higher than or equal to the set value.

The thermostat 45 detects an abnormal temperature rise of the fixing roller 41. In a case where the thermostat 45 detects an abnormal temperature rise, the heat source 43 immediately stops heating the fixing roller 41. The thermostat 45 is provided in a region close to the heat source 43 and above a surface of the fixing roller 41.

The discharge section 5 includes a carrying roller 51, a discharge roller 52, storage sections 53*a* and 53*b* and a switching gate 54. The carrying roller 51 carries the sheet on which the toner image has been fixed from the fixing device 4 to the discharge roller 52. The discharge roller 52 discharges the sheet carried from the fixing device 4 to the storage section 53*a* or the storage section 53*b*. The storage sections 53*a* and 53*b* store the sheet on which the toner image has been fixed. The switching gate 54 determines to which of the storage section 53*a* and the storage section 53*b* the discharge roller 52 discharges the sheet.

FIG. 2 is a block diagram that shows an electric configuration of the image forming apparatus 100. As shown in FIG. 2, the image forming apparatus 100 includes a control unit 7, a detecting section 8, a power supply section 9 and a drive section 10.

The detecting section 8 is a sensor that is provided in various positions inside the image forming apparatus 100. The detecting section 8 includes the above-described thermistor 44, thermostat 45 and like members. The power supply section 9 supplies electric power to the members constituting the image forming apparatus 100. The power supply section 9 includes, for example, a power supply that supplies power to the heat source 43, which power is used to heat the heat source 43. The drive section 10 drives the members constituting the image forming apparatus 100. The drive section 10 includes, for example, a drive motor that causes the above-described fixing roller 41 to rotate.

The control unit 7 is provided in an upper part of an internal space of the image forming apparatus 100, and controls the members constituting the image forming apparatus 100. The control unit 7 includes a memory section 71, an operation section 72 and a control section 73.

The memory section 71 stores (i) various set values entered via an operation panel (not shown) that is provided on an upper surface of the image forming apparatus 100, (ii) a detection result by the detecting section 8, (iii) image information received from an external device, and the like. The external device is an electric or electronics device which can form or obtain the image information and which is electrically connectable to the image forming apparatus 100. Examples of the external device encompass a terminal device (personal computer), a digital camera, a television receiver, a video recorder, a DVD (Digital Versatile Disc) recorder, a HDDVD (High-Definition Digital Versatile Disc) recorder, a Blu-ray disc recorder, a facsimile machine, and a mobile terminal device. The memory section 71 also stores programs that execute various processes. Examples of the processes encompass a sheet determination process, an adhesion rate control process, and a fixing control process.

Well-known memory devices are usable as the memory section 71. Examples of the memory section 71 encompass a read only memory (ROM), a random access memory (RAM), and a hard disc drive (HDD).

The operation section 72 extracts (i) the various data (various set values, a detection result, image information and the like) and (ii) the programs that execute various processes, which (i) and (ii) are stored in the memory section 71, and then carries out various information processes. The control section 73 transmits a control signal to a device that is to be controlled, based on a result obtained by the process of the operation section 72, and thus controls the operation of the device. The control section 73 and the operation section 72 are computers such as a central processing unit (CPU) or a microprocessor.

One example of the fixing control process carried out by the control unit 7 is as follows. The control section 73, after receiving input of an image forming instruction, transmits a control signal to a power supply that supplies an electric power to the heat source 43, and also transmits a control signal to a drive motor that rotates the fixing roller 41. The image forming instruction is inputted from the operation panel of the image forming apparatus 100, an external device that is connected to the image forming apparatus 100, or the like. The power supply that receives the control signal supplies an electric power to the heat source 43. The electric power causes the heat source 43 to generate heat, and the heat generated by the heat source 43 heats the fixing roller 41. The drive motor that receives the control signal causes the fixing roller 41 to rotate. The rotation of the fixing roller 41 causes the pressure roller 42 to rotate. In this state, the thermistor 44 detects a surface temperature of the fixing roller 41 and then transmits its detection result to the control unit 7. The operation section 72 determines, based on the detected temperature by the thermistor 44 and the set temperature stored in the memory section 71, whether or not the surface temperature of the fixing roller 41 has reached the set value. After the operation section 72 determines that the surface temperature of the fixing roller 41 has reached the set value, the control section controls the devices included in the image forming apparatus 100 and commences an image forming process. This causes the sheet on which the unfixed toner image is formed to be carried to the fixing nip section. The above-described process of controlling the fixing device 4 is the fixing control process.

Figure 3:
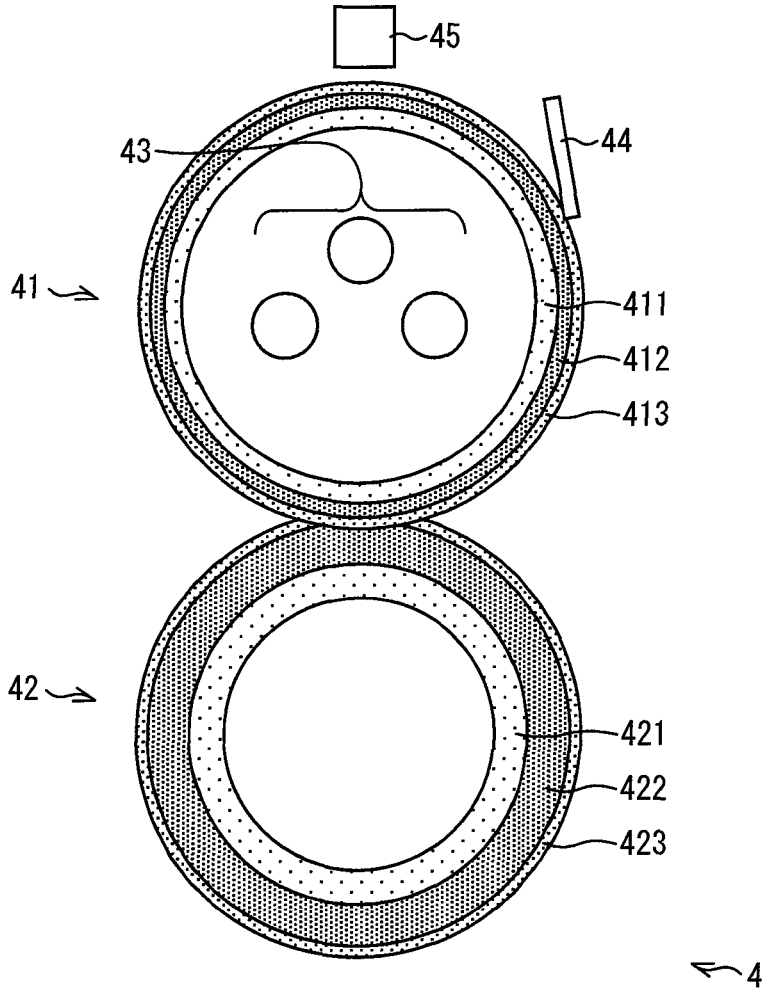
FIG. 3 is a view schematically showing a cross section of a fixing device of the present embodiment.

The following describes a concrete configuration of the fixing device 4. FIG. 3 is a view schematically showing a cross section of the fixing device 4. Specifically, FIG. 3 is a view schematically showing a cross section of the fixing roller 41 in a case where the cross section is taken along a surface perpendicular to the axis of the fixing roller 41 at a mid part of the fixing roller 41 in an axis direction.

The fixing device 4 includes the fixing roller 41, the pressure roller 42 and the heat source 43. The fixing roller 41 is a roller member whose both ends of its shaft in an axis direction are supported rotatably and which is rotated by a drive motor (drive section) that is not shown in FIG. 3. The pressure roller 42 is a roller member whose both ends of its shaft in an axis direction are supported rotatably and which rotates in accordance with the rotation of the fixing roller 41. The heat source 43 is a member which is provided inside the fixing roller 41 and which heats the fixing roller 41 from the inside. An example of the heat source 43 is a heater such as a halogen lamp.

As shown in FIG. 3, in the fixing device 4 of the present embodiment, the pressure roller 42 is pressed against and is made in contact with the fixing roller 41. This causes the pressure roller 42 to elastically deform in shape. This elastic deformation forms the abutted part (fixing nip section), where the fixing roller 41 and the pressure roller 42 are in contact with each other. Further, the sheet is carried by being sandwiched between the fixing roller 41 and the pressure roller 42 at the abutted part. As a result, the unfixed toner formed on a surface of the sheet which surface contacts the fixing roller 41 is melted by heat and is fixed onto the sheet.

The fixing roller 41 of the present embodiment is a roller that has been reduced in heat capacity. As shown in FIG. 3, the fixing roller 41 includes a core bar 411, an elastic layer 412, and a release layer 413. The core bar 411 is made of a metal having a high heat conductivity in order to reduce the heat capacity of the fixing roller 41. In the present embodiment, the core bar 411 made of iron is used. However, a core bar made of aluminum may also be used.

The core bar 411 is of a hollow cylindrical shape. Further, both ends of the core bar 411 of the present embodiment in its axis direction may be tapered. Such a tapered structure is formed in order to increase strength against deflection under load. Note that the tapered structure is not necessarily formed.

The elastic layer 412 is formed on a peripheral surface of the core bar 411. Specifically, the elastic layer 412 is formed between the core bar 411 and the release layer 413. The elastic layer 412 is made of material having rubber elasticity. More preferably, the elastic layer 412 is made of material not only having the rubber elasticity but also having an excellent heat resistance. Examples of the material having the excellent heat resistance and rubber elasticity encompass silicon rubber, fluorocarbon rubber and fluorosilicon rubber. Any one of these rubbers can be used as the elastic layer 412. Among these rubbers, it is particularly preferable to use the silicon rubber, since the silicon rubber has the most excellent rubber elasticity. The elastic layer 412 of the present embodiment is made of the silicon rubber.

An elastic layer of the fixing roller should not be excessively thick, in order to improve temperature following capability of the fixing roller which greatly affects fixing capability in a high-speed machine (for example, a printer exclusive to monochrome printing). For example, if the elastic layer of the fixing roller has a thickness exceeding 500 μm, heat capacity of the fixing roller is excessively increased. This causes a marked delay in the warm-up period, and further causes a response speed to slow down upon controlling the temperature of the fixing roller based on information of the temperature detected by the thermistor or the like. Meanwhile, the elastic layer of the fixing roller is neither preferable to be excessively thin. For example, if the elastic layer of the fixing roller has a thickness of less than 100 μm, the following capability of the surface of the fixing roller with respect to a sheet surface decreases. This tends to cause image unevenness and reduction in the fixing capability. It is therefore preferable that the elastic layer of the fixing roller has a thickness that ranges from 100 μm to 500 μm.

The release layer (surface layer) 413 is formed on a peripheral surface of the elastic layer 412, and is a layer that serves as the surface of the fixing roller 41. The release layer 413 is made of material which has good heat resistance and endurance and low adhesiveness with toner. Examples of the material of the release layer 413 encompass: fluorocarbon resin materials such as PFA (copolymer of tetrafluoroethylene and perfluoroalkylvinyl ether) and PTFE (polytetrafluoroethylene); and fluorocarbon rubber.

Further, according to the present embodiment, the elastic layer is formed on the fixing roller in order to improve the following capability of the surface of the fixing roller with respect to the sheet surface. This improves adhesiveness of the fixing roller with the sheet and thus further improves the fixing capability. However, if the fixing roller having the elastic layer is arranged to have an excessively thick release layer (surface layer) formed on the periphery of the elastic layer, an effect yielded by the elastic layer is less attained. On the other hand, if the release layer of the fixing roller is too thin, the endurance of the fixing roller deteriorates. In order to take advantage of the effect yielded by the elastic layer included in the fixing roller while sufficiently obtaining the endurance of the fixing roller, it is preferable that the release layer 413 of the fixing roller 41 has a thickness that ranges from 20 μm to 50 μm.

The pressure roller 42 is provided in a rotatable state while being pressed against the fixing roller 41 by a pressure mechanism (not shown). The pressure mechanism is a mechanism that switches between a first state where the pressure roller 42 is pressed against the fixing roller 41 and a second state where the pressure roller 42 is released from the fixing roller 41. The pressure mechanism switches to the first state while an image forming process is carried out, and switches to the second state at times other than while the image forming process is carried out. This prevents plastic deformation of the fixing roller 41 due to the pressure applied by the pressure roller 42. Further, if the pressure roller 42 is left for long periods in a state of being pressed against the fixing roller 41, compressed permanent distortion may occur to the elastic layer of the pressure roller. However, by providing the pressure mechanism, it is possible to prevent occurrence of this compressed permanent distortion. Note, however, that the pressure mechanism is not particularly an essential configuration. In a case where the pressure mechanism is not provided, the pressure roller is always pressed against the fixing roller.

As shown in FIG. 3, the pressure roller 42 of the present embodiment includes a core bar 421, an elastic layer 422 and a release layer 423. The core bar 421 can be made of a same material as that of the core bar 411 of the fixing roller 41. The core bar 421 is of a hollow cylindrical shape. Further, both ends of the core bar 421 in an axis direction may be tapered, in order to increase strength against deflection under load.

The elastic layer 422 is formed on the peripheral surface of the core bar 421. Specifically, the elastic layer 412 is formed between the core bar 411 and the release layer 413. The elastic layer 422 can be made of a same material as that of the elastic layer 412 of the fixing roller 41. Further, the elastic layer 422 of the pressure roller 42 has a thickness that ranges from 2 mm to 10 mm.

The release layer (surface layer) 423 is formed on the peripheral surface of the elastic layer 422, and is a layer that serves as a surface of the pressure roller 42. The release layer 423 can be made of a same material as that of the release layer 413 of the fixing roller 41. Further, the release layer 423 of the pressure roller 42 has a thickness that ranges from 20 μm to 150 μm. That is, in the present embodiment, the release layer 423 of the pressure roller 42 is thicker than the release layer 413 of the fixing roller 41.

Furthermore, columnar bosses each having a diameter of 8 mm are compressively bonded to both ends in an axis direction of the pressure roller 42, and ball bearings are attached to the ends to which the columnar bosses have been compressively bonded, to allow the pressure roller 42 to rotate in accordance with the rotation of the fixing roller. Moreover, in the present embodiment, the pressure roller 42 is pressed against the fixing roller 41 with a uniform pressure (total load of 600 N) applied in an axis direction, by the pressure mechanism.

Asker-C hardness and micro rubber hardness are employed as indicators for evaluating hardness of the fixing roller 41 and of the pressure roller 42. The micro rubber hardness has a greater correlation with respect to hardness of the vicinity of a roller surface than that with respect to hardness of a whole roller. The Asker-C hardness has a greater correlation with respect to the hardness of the whole roller than that with respect to the hardness of the vicinity of the roller surface. That is, the micro rubber hardness serves as an indicator of the hardness of the vicinity of the roller surface, and the Asker-C hardness serves as an indicator of the hardness of the whole roller. For example, assume that there exist a first roller and a second roller, each of which has a release layer (surface layer) formed on a peripheral surface of an elastic layer. In a case where (i) the release layer of the first roller has a greater hardness than that of the second roller and (ii) a layer combining the release layer and elastic layer of the second roller has a greater hardness than that of the first roller, the Asker-C hardness of the second roller is greater than that of the first roller, while the micro rubber hardness of the first roller is greater than that of the second roller.

In the present embodiment, the fixing roller 41 and the pressure roller 42 are designed and selected so that the Asker-C hardness of the fixing roller 41 is greater than that of the pressure roller 42 and that the micro rubber hardness of the pressure roller 42 is greater than that of the fixing roller 41. These designed and selected fixing roller 41 and pressure roller 42 are provided in the fixing device 4.

The Asker-C hardness and the micro rubber hardness of the rollers depend on factors such as thickness of the elastic layer, hardness of the elastic layer and thickness of the release layer. Hence, by determining the hardness of the elastic layer, thickness of the elastic layer and thickness of the release layer of the fixing roller and the pressure roller as appropriate, it is possible to set the Asker-C hardness of the fixing roller 41 to be greater than that of the pressure roller 42, and the micro rubber hardness of the pressure roller 42 to be greater than that of the fixing roller 41.

Specifically, as shown in FIG. 4, the thickness of the elastic layer, hardness of the elastic layer and thickness of the release layer of the fixing roller 41 are set as those of a fixing roller A, and the thickness of the elastic layer, hardness of the elastic layer and thickness of the release layer of the pressure roller 42 are set as those of either pressure roller E or pressure roller F. Such setting allows the Asker-C hardness of the fixing roller 41 to be greater than that of the pressure roller 42 and also allows the micro rubber hardness of the pressure roller 42 to be greater than that of the fixing roller 41. The fixing roller A is an example of the fixing roller 41 of the present embodiment and has components identical to those of the fixing roller 41 of the present embodiment. The thickness of the elastic layer, hardness of the elastic layer and thickness of the release layer of the fixing roller A are set by values shown in FIG. 4. Further, the pressure rollers E and F each are an example of the pressure roller 42 of the present embodiment. The thickness of the elastic layer, hardness of the elastic layer and thickness of the release layer of the pressure rollers E and F are set by values shown in FIG. 4.

As described above, in the fixing device 4, the Asker-C hardness of the pressure roller 42 is lower than that of the fixing roller 41. Therefore, as shown in FIG. 3, the pressure roller 42 is greatly distorted due to elastic deformation as compared to the fixing roller 41, and thus the pressure roller 42 is given a greater load (stress) than that given to the fixing roller 41. However, the micro rubber hardness of the pressure roller 42 is set to be greater than that of the fixing roller 41. Therefore, the pressure roller 42 has a greater endurance than that of the fixing roller 41 when focusing on just the roller surfaces. Therefore, even if the pressure roller 42 is given a greater load (stress) than that given to the fixing roller 41, it is possible to prevent the occurrence of a state in which just the surface of the pressure roller is deteriorated in a short period of time.

Further, a manufacturer that manufactures the fixing device may carry out steps of (i) measuring the Asker-C hardness and the micro rubber hardness of the fixing roller 41 and the pressure roller 42 and (ii) determining the fixing devices based on the following criterion: a fixing device in which the Asker-C hardness of the pressure roller 42 is lower than that of the fixing roller 41 and the micro rubber hardness of the pressure roller 42 is greater than that of the fixing roller is acceptable; and a fixing device other than the above-described fixing device is unacceptable. By carrying out these steps, it is possible to eliminate, from commercial fixing devices, a fixing device in which just the pressure roller deteriorates in a short period of time.

EXPERIMENTAL EXAMPLE

The present inventor conducted experiments (endurance experiment) for finding endurance of a roller, in order to identify performance of a fixing device in which the Asker-C hardness of the fixing roller 41 is greater than that of the pressure roller 42 and in which the micro rubber hardness of the pressure roller 42 is greater than that of the fixing roller 41. The following describes the endurance experiment.

First, the fixing roller A and pressure rollers B through F shown in FIG. 4 were prepared. As described above, the fixing roller A had components identical to those of the fixing roller 41 of the present embodiment, and the thickness of the elastic layer, hardness of the elastic layer and thickness of the release layer of the fixing roller A were set by values shown in FIG. 4. Further, the pressure rollers B, C, D, E and F shown in FIG. 4 each had components identical to those of the pressure roller 42 of the present embodiment, and the thickness of the elastic layer, hardness of the elastic layer and thickness of the release layer of the pressure rollers B through F were set by values shown in FIG. 4. The following explanation first describes specifications of the fixing roller A and pressure rollers B through F used in the endurance experiment.

(Fixing Roller A)

The fixing roller A used a core bar made of iron, which core bar had an outer diameter of 39.6 mm, an inside diameter of 38.3 mm and a radial thickness of 0.65 mm. The core bar was tapered at both ends in an axis direction of the core bar. An elastic layer formed on a periphery of the core bar was made of silicon rubber having a low hardness that shows a JIS-A hardness of 10 degrees. A release layer (surface layer) formed on a periphery of the elastic layer was made of a PFA (copolymer of tetrafluoroethylene and perfluoroalkylvinyl ether) tube. The elastic layer was 200 μm in thickness (length in a diameter direction of the fixing roller A), and the release layer was 30 μm in thickness. The fixing roller A was designed to have an outer diameter of 40.06 mm and a body length in an axis direction of 314 mm. The core bar included three halogen lamps that served as a heat source, on an inner periphery of the core bar. Specifically, the three halogen lamps were: a main lamp having a normal rated power of 700 W which main lamp was used for heating a center part of a sheet; a sub-lamp having a normal rated power of 250 W which sub-lamp was used for heating both ends of the sheet; and an auxiliary lamp having a normal rated power of 250 W which auxiliary lamp lights only during a warm-up operation. At the time of the warm-up, electric power of 1200 W was applied to the heat source, and electric power of 950 W was applied to the heat source while a sheet is passed through the fixing device.

(Pressure Roller B)

The fixing roller B used an iron core bar having no tapered structure, which core bar had an outer diameter of 29.76 mm, an inside diameter of 23.76 mm and a radial thickness of 3 mm. An elastic layer formed on a periphery of the core bar was made of silicon rubber showing a JIS-A hardness of 30 degrees. A release layer formed on a periphery of the elastic layer was made of the PFA tube. The elastic layer was 5 mm in thickness, and the release layer was 50 μm in thickness. The fixing roller B was designed to have an outer diameter of 40.00 mm. The core bar was designed to have a length in an axis direction of 313 mm. The elastic layer was designed to have a length in an axis direction of 312 mm.

(Pressure Roller C)

The pressure roller C used a core bar identical to that of the pressure roller B. An elastic layer formed on a peripheral surface of the core bar was made of silicon rubber showing a JIS-A hardness of 40 degrees. A release layer formed on a periphery of the elastic layer was made of the PFA tube. Further, the pressure roller C was designed so that a thickness of the elastic layer, a length in an axis direction of the elastic layer, a thickness of the release layer and an outer diameter of the pressure roller C had values identical to those of the pressure roller B.

(Pressure Roller D)

The pressure roller D used a core bar identical to that of the pressure roller B. An elastic layer formed on a peripheral surface of the core bar was made of silicon rubber showing a JIS-A hardness of 40 degrees. A release layer formed on a periphery of the elastic layer was made of the PFA tube. Further, the pressure roller D was designed so that a thickness of the elastic layer, a length in an axis direction of the elastic layer and an outer diameter of the pressure roller D had values identical to those of the pressure roller B. Note that the release layer of the pressure roller D was designed to be 70 μm in thickness.

(Pressure Roller E)

The pressure roller E used a core bar identical to that of the pressure roller B. An elastic layer formed on a peripheral surface of the core bar was made of silicon rubber showing a JIS-A hardness of 30 degrees. Further, the pressure roller E was designed so that a thickness of the elastic layer, a length in an axis direction of the elastic layer and an outer diameter of the pressure roller E had values identical to those of the pressure roller B. Note that the release layer of the pressure roller E was designed to be 120 μm in thickness.

(Pressure Roller F)

The pressure roller F used a core bar identical to that of the pressure roller B. An elastic layer formed on a peripheral surface of the core bar was made of silicon rubber showing a JIS-A hardness of 40 degrees. Further, the pressure roller F was designed so that a thickness of the elastic layer, a length in an axis line direction of the elastic layer and an outer diameter of the pressure roller F had values identical to those of the pressure roller B. Note that the release layer of the pressure roller F was designed to be 120 μm in thickness.

(Hardness)

The present inventor measured the Asker-C hardness and micro rubber hardness of the above-described rollers, before conducting the endurance experiment of the rollers. FIG. 4 shows its measurement result. The Asker-C hardness was measured by use of ASKER Durometer Type C manufactured by KOBUNSHI KEIKI CO., LTD. The micro rubber hardness was measured by use of MD-1 capa manufactured by KOBUNSHI KEIKI CO., LTD. Specifically, the Asker-C hardness was measured as follows: a needle of the ASKER Durometer Type C was pressed against a peripheral surface (a surface of a release layer) of a roller to obtain a measurement value, under a load condition of 1 kgf. Further, the micro rubber hardness was measured as follows: a needle having a needle form of type A was pressed against the peripheral surface of the roller to obtain a measurement result, under the load condition of 1 kgf.

(Endurance Experiment)

A fixing device including the fixing roller A and each of the pressure rollers B through F was constructed, and endurance of the rollers in the fixing device was evaluated. Specifically, as shown in FIG. 5, the endurance experiment was conducted as follows. A fixing device including the fixing roller A and the pressure roller E was set as Example 1; a fixing device including the fixing roller A and the pressure roller F was set as Example 2; a fixing device including the fixing roller A and the pressure roller B was set as Comparative Example 1; a fixing device including the fixing roller A and the pressure roller C was set as Comparative Example 2; and a fixing device including the fixing roller A and the pressure roller D was set as Comparative Example 3.

According to Examples 1 and 2 and Comparative Examples 1 through 3, sheets were successively passed through the rollers, to evaluate the endurance of the rollers. Specifically, the sheets were successively passed through the rollers at a processing rate of 395 mm/sec and at a sheet passage rate of 75 sheets per minute. Further, the sheets used in this endurance experiment were regular papers having a size of A4 and a basic weight of 64 g/m$^2$.

Specifically, according to Examples and Comparative Examples, endurance of the fixing roller and endurance of the pressure roller were evaluated by visual inspection after 300,000 sheets have successively been passed through the fixing roller and the pressure roller, and the endurance of the fixing roller and the endurance of the pressure roller were also evaluated by visual inspection after 500,000 sheets have successively been passed through the fixing roller and the pressure roller. FIG. 5 shows the evaluation result. In FIG. 5, "○" (white circle) indicates that the roller had no problem (no wrinkle, no crack, and no damage), "□" (white square) indicates that the roller had no wrinkle or no crack but had a shallow scratch, "x" (cross) indicates that the roller had a few wrinkles, "xx" (two crosses) indicates that the roller had a marked wrinkle, and "–" (hyphen) indicates that a wrinkle or a crack generated in the roller after 300,000 sheets have successively been passed through the fixing roller and the pressure roller and thus an evaluation after passage of 500,000 sheets was not conducted.

At a point where 300,000 sheets have been successively passed through the fixing roller and the pressure roller, no wrinkle or crack was generated in the release layer (tube layer) of the fixing roller, with all Comparative Examples and Examples. However, a marked wrinkle was observed in the release layer of the pressure roller with Comparative Example 1 after 300,000 sheets have been successively passed through the fixing roller and the pressure roller. Further, although less marked than the wrinkle occurred in the release layer of the pressure roller of Comparative Example 1, a wrinkle also generated in the release layer of the pressure roller of Comparative Example 2, after 300,000 sheets have been successively passed through the fixing roller and the pressure roller. Further, the release layer of the pressure roller of Comparative Example 3 showed a damage of a degree of a shallow scratch after 300,000 sheets have been successively passed through the fixing roller and the pressure roller, and this damage was observed as a wrinkle after 500,000 sheets have been successively passed through the fixing roller and the pressure roller. Meanwhile, Examples 1 and 2 which had the release layer of the pressure roller be a thickness of 120 μm and the micro rubber hardness of the pressure roller be set greater than that of the fixing roller, showed no wrinkle, crack or the like in the release layer of the pressure roller after 300,000 sheets have been successively passed through the fixing roller and the pressure roller.

Further, a slight damage was observed in the release layer of the fixing roller with all Comparative Examples and Examples, after 500,000 sheets have been successively passed through the fixing roller and the pressure roller. After 500,000 sheets have been successively passed through the fixing roller and the pressure roller, generation of a wrinkle and a crack were observed in the release layer of the pressure roller of Comparative Examples 1 and 2, and a wrinkle was observed in the release layer of the pressure roller of Comparative Example 3. However, just a slight damage was observed in the release layer of the pressure roller with Examples 1 and 2, after 500,000 sheets have been successively passed through the fixing roller and the pressure roller.

In the above-described endurance experiment, Examples 1 and 2 in which the micro rubber hardness of the pressure roller is greater than that of the fixing roller resulted to show a substantially similar endurance between the pressure roller and the fixing roller. Comparative Examples 1 through 3 in which the micro rubber hardness of the pressure roller is lower than that of the fixing roller resulted in that the pressure roller deteriorated faster than the fixing roller, in a clearly shorter time.

Next studies the result of the endurance experiment. As shown in FIGS. 4 and 5, the Asker-C hardness of the fixing roller is greater than that of the pressure roller in all Examples and Comparative Examples. That is, with all Examples and Comparative Examples, the elastic layer of the pressure roller distorted greater than that of the fixing roller, and therefore the elastic layer and the release layer of the pressure roller are subject to a greater stress than a stress applied to the elastic layer and the release layer of the fixing roller.

In comparison, in Examples 1 and 2 which have the micro rubber hardness of the pressure roller greater than that of the fixing roller, the release layer of the pressure roller has a greater endurance than that of the release layer of the fixing roller. Therefore, in Examples 1 and 2, it can be considered that the endurance of the pressure roller is substantially same as that of the fixing roller, even if the elastic layer and the release layer of the pressure roller are subject to a greater stress than the stress applied to the elastic layer and release layer of the fixing roller.

However, with Comparative Examples 1 through 3 in which the micro rubber hardness of the pressure roller is lower than that of the fixing roller, the elastic layer and release layer of the pressure roller are subject to a greater stress than the stress applied to the elastic layer and release layer of the fixing roller, and further the endurance of the release layer of the pressure roller is lower than that of the release layer of the fixing roller. It can therefore be considered that the pressure roller deteriorated faster than the fixing roller, in a clearly shorter time.

Recently, a fixing device in which a fixing roller including an elastic layer is pressed against a pressure roller including an elastic layer has been designed to have a temperature of the fixing roller (fixing temperature) set high and have a fixing nip width as narrow as possible, in order to attain fixing capability while preventing heat from transferring to a sheet as much as possible. However, a narrow fixing nip width causes a great increase in the amount of pressure given on the fixing nip section. This causes a great load on the pressure roller. Meanwhile, the present invention improves the endurance of the pressure roller. As a result, it is possible to prevent the pressure roller from deteriorating at a short period of time even if the fixing nip is reduced in width.

The fixing device of the present embodiment is applied to an image forming apparatus in which the pressure roller is elastically deformed to a greater degree than that of the fixing roller. An image forming apparatus exclusive to monochrome printing is usually designed such that the pressure roller is elastically deformed to a greater degree than that of the fixing roller. Therefore, the fixing device of the present embodiment is suitably applicable to such an image forming apparatus exclusive to monochrome printing. Furthermore, the fixing device of the present embodiment is also applicable to an image forming apparatus capable of full-color printing if the image forming apparatus capable of full-color printing is designed such that the pressure roller is elastically deformed to a greater degree than that of the fixing roller. This is because the problem that can be solved by the present invention occurs in the image forming apparatus capable of full-color printing.

The following describes differences between Patent Literatures 1 through 4 and the present embodiment. Patent Literature 1 defines micro hardness of a fixing roller in order to improve fixing capability to an OHP sheet. Patent Literature 2 defines micro hardness and Asker-C hardness of a pressure roller in order to prevent a surface of the pressure roller from being contaminated. Patent Literature 3 defines physical properties of an elastic layer provided in a pressure roller, to improve endurance of the pressure roller. Patent Literature 4 defines hardness of a pressure roller and hardness of a fixing roller, to prevent deterioration in an image quality of two-sided printing. However, none of Patent Literatures 1 through 4 disclose setting micro rubber hardness of the pressure roller to be greater than that of the fixing roller, as disclosed in the present embodiment.

Further, although Patent Literatures 1 and 2 include descriptions regarding the micro hardness of the fixing roller or the pressure roller, these Literatures do not include any description regarding endurance of the fixing roller or the pressure roller. Patent Literature 3 includes a description regarding endurance of the pressure roller, however does not disclose the endurance of the pressure roller in terms of the relationship with a fixing roller. Patent Literature 4 discloses that micro hardness of a pressure rotor is set to be lower than that of a heat rotor (fixing roller), however does not include any description regarding endurance of the rotor.

As described above, the fixing device of the present embodiment includes: a fixing roller; a pressure roller; and a heat source that heats the fixing roller, each of the fixing roller and the pressure roller including a core bar, an elastic layer, and a release layer, the elastic layer being sandwiched between the core bar and the release layer, the release layer serving as a surface of a respective fixing roller and pressure roller, the pressure roller being pressed against and made in contact with the fixing roller to form an abutted part where the pressure roller is in contact with the fixing roller, the fixing roller and the pressure roller sandwiching and carrying a sheet at the abutted part to melt by heat, and fix to the sheet, unfixed toner provided on a surface of the sheet which surface is to be in contact with the fixing roller, the pressure roller having a lower Asker-C hardness than that of the fixing roller and having a greater micro rubber hardness than that of the fixing roller. According to the arrangement, the pressure roller having a lower Asker-C hardness than that of the fixing roller is pressed against and is in contact with the fixing roller. Hence, the pressure roller is distorted in a greater degree than the fixing roller due to elastic deformation, or just the pressure roller is distorted due to the elastic deformation while no distortion occurs to the fixing roller due to the elastic deformation. However, since the pressure roller has a greater micro rubber hardness than that of the fixing roller, the pressure roller has a greater endurance than that of the fixing roller in terms of just the roller surfaces. This yields an effect that it is possible to prevent the occurrence of a case where just the surface of the pressure roller is deteriorated in a short period of time.

It is preferable that the release layer of the pressure roller is thicker than that of the fixing roller. It is therefore possible to increase surface hardness of the pressure roller, thereby yielding an effect of further improving endurance of the surface of the pressure roller.

It is preferable that the heat source is provided inside the fixing roller, and the elastic layer of the fixing roller has a thickness ranging from 100 μm to 500 μm. This yields an effect that a warm-up period is shortened and temperature following capability is improved. Further, the fixing roller including the elastic layer yields a merit that a surface of the fixing roller sufficiently follows a sheet surface; preferable fixing capability is maintainable without impairing the merit by having the elastic layer of the fixing roller be a thickness that ranges from 100 μm to 500 μm.

The fixing device of the present embodiment is provided in an image forming apparatus. Examples of the image forming apparatus encompass a multifunction printer, a copying machine, a printer and a facsimile.

A method for evaluating a fixing device of the present embodiment, which fixing device includes: a fixing roller; a pressure roller; and a heat source that heats the fixing roller, each of the fixing roller and the pressure roller including a core bar, an elastic layer and a release layer, the elastic layer being sandwiched between the core bar and the release layer, the release layer serving as a surface of a respective fixing roller and pressure roller, the pressure roller being pressed against and made in contact with the fixing roller to form an abutted part where the pressure roller is in contact with the fixing roller, the fixing roller and the pressure roller sandwiching and carrying a sheet at the abutted part to melt by heat, and fix to the sheet, unfixed toner provided on a surface of the sheet which surface is to be in contact with the fixing roller, is a method including the steps of: measuring Asker-C hardness and micro rubber hardness of each of the fixing roller and pressure roller; and determining, as acceptable, a fixing device wherein the pressure roller has a lower Asker-C hardness than that of the fixing roller and has a greater micro rubber hardness than that of the fixing roller. This yields an effect that it is possible to eliminate a fixing device in which just the pressure roller deteriorates in a short period of time.

The present invention is not limited to the description of the embodiments above, but may be altered by a skilled person within the scope of the claims. An embodiment based on a proper combination of technical means disclosed in different embodiments is encompassed in the technical scope of the present invention.

INDUSTRIAL APPLICABILITY

The present invention is applicable to a fixing device that is provided in an electrophotographic image forming apparatus. Examples of the image forming apparatus encompass a multifunction printer, a copying machine, a printer and a facsimile.

REFERENCE SIGNS LIST

4 fixing device
41 fixing roller
42 pressure roller
43 heat source
100 image forming apparatus
411 core bar
412 elastic layer
413 release layer
421 core bar
422 elastic layer
423 release layer

The invention claimed is:

1. A fixing device, comprising:
a fixing roller;
a pressure roller; and
a heat source that heats the fixing roller,
each of the fixing roller and the pressure roller including a core bar, an elastic layer and a release layer, the elastic layer being sandwiched between the core bar and the release layer, the release layer serving as a surface of a respective fixing roller and pressure roller,
the pressure roller being pressed against and made in contact with the fixing roller to form an abutted part where the pressure roller is in contact with the fixing roller,
the fixing roller and the pressure roller sandwiching and carrying a sheet at the abutted part to melt by heat, and fix to the sheet, unfixed toner provided on a surface of the sheet which surface is to be in contact with the fixing roller,
the pressure roller having a lower Asker-C hardness than that of the fixing roller and having a greater micro rubber hardness than that of the fixing roller.

2. The fixing device as set forth in claim 1, wherein:
the release layer of the pressure roller is thicker than that of the fixing roller.

3. The fixing device as set forth in claim 1, wherein:
the heat source is provided inside the fixing roller, and
the elastic layer of the fixing roller has a thickness ranging from 100 μm to 500 μm.

4. An image forming apparatus, comprising a fixing device as set forth in claim 1.

5. A method for evaluating a fixing device,
the fixing device comprising:
a fixing roller;
a pressure roller; and
a heat source that heats the fixing roller,
each of the fixing roller and the pressure roller including a core bar, an elastic layer and a release layer, the elastic layer being sandwiched between the core bar and the release layer, the release layer serving as a surface of a respective fixing roller and pressure roller,
the pressure roller being pressed against and made in contact with the fixing roller to form an abutted part where the pressure roller is in contact with the fixing roller,
the fixing roller and the pressure roller sandwiching and carrying a sheet at the abutted part to melt by heat, and fix to the sheet, unfixed toner provided on a surface of the sheet which surface is to be in contact with the fixing roller,
said method comprising the steps of:

measuring Asker-C hardness and micro rubber hardness of each of the fixing roller and pressure roller; and determining, as acceptable, a fixing device wherein the pressure roller has a lower Asker-C hardness than that of the fixing roller and has a greater micro rubber hardness than that of the fixing roller.

* * * * *